US009738500B2

(12) United States Patent
Lowe

(10) Patent No.: US 9,738,500 B2
(45) Date of Patent: Aug. 22, 2017

(54) LOCKABLE LIFT DEVICE AND METHOD

(71) Applicant: ADVANCE LIFTS, INC., St. Charles, IL (US)

(72) Inventor: Brian C. Lowe, Sycamore, IL (US)

(73) Assignee: ADVANCE LIFTS, INC., St. Charles, IL (US)

( * ) Notice: Subject to any disclaimer, the term of this patent is extended or adjusted under 35 U.S.C. 154(b) by 308 days.

(21) Appl. No.: 14/641,869

(22) Filed: Mar. 9, 2015

(65) Prior Publication Data

US 2015/0314988 A1 Nov. 5, 2015

Related U.S. Application Data

(60) Provisional application No. 61/986,573, filed on Apr. 30, 2014.

(51) Int. Cl.
*B66B 9/02* (2006.01)
*B66F 7/06* (2006.01)
*B66F 7/08* (2006.01)

(52) U.S. Cl.
CPC ..... *B66F 7/0666* (2013.01); *B66B 9/02* (2013.01); *B66F 7/08* (2013.01)

(58) Field of Classification Search
CPC ..... B66F 1/02; B66F 7/065; B66F 2700/25; B66F 2700/02; B66F 7/0666; B66F 3/22; B66F 7/0658
See application file for complete search history.

(56) References Cited

U.S. PATENT DOCUMENTS 3,282,449 A 11/1966 Buford
3,831,713 A * 8/1974 Clarke ..... B66F 7/00 187/203
4,076,104 A 2/1978 Bishop et al.
4,110,860 A 9/1978 Neff et al.
4,312,619 A * 1/1982 Anderson ..... B64F 1/32 180/14.2
4,488,326 A * 12/1984 Cherry ..... B66F 7/0625 14/69.5
4,995,130 A 2/1991 Hahn et al.
5,111,546 A 5/1992 Hahn et al.
5,460,460 A 10/1995 Alexander
5,771,995 A 6/1998 Cooney et al.
(Continued)

*Primary Examiner* — William E Dondero
*Assistant Examiner* — Diem Tran
(74) *Attorney, Agent, or Firm* — Marshall, Gerstein & Borun LLP

(57) ABSTRACT

A scissor lift includes a base, a platform, a plurality of pivotally connected scissor links, a support column, and a locking actuator. The platform has a fixed horizontal orientation and being movable between a first elevation and a second elevation. The scissor links are arranged in a criss-cross pattern and operatively connecting the base and the platform. The lift actuator is pivotally attached to at least one of the scissor links to selectively raise and lower the platform along a lift path. The support column extends alongside the lift path and positioned adjacent to the platform. The locking actuator is fixed to an underside of the platform and includes a piston member extendable toward the support column to operatively connect the platform with the support column when the platform is raised at the second elevation so that the platform is supported by the support column in the fixed horizontal orientation.

21 Claims, 9 Drawing Sheets

(56) References Cited

U.S. PATENT DOCUMENTS

| | | | | |
|---|---|---|---|---|
| 5,773,771 | A | 6/1998 | Chatham | |
| 5,915,909 | A | 6/1999 | Smith | |
| 5,941,347 | A | 8/1999 | Pfleger et al. | |
| 7,207,419 | B2 | 4/2007 | Fore et al. | |
| 8,006,751 | B2 | 8/2011 | Lambert et al. | |
| 8,540,214 | B2 | 9/2013 | Christian | |
| 8,689,945 | B2 | 4/2014 | Arai et al. | |
| 9,410,329 | B2 * | 8/2016 | Keersmaekers | B66B 9/02 |
| 2008/0169158 | A1 | 7/2008 | Lam | |
| 2009/0260925 | A1 * | 10/2009 | Schilling | B66B 9/02 187/269 |

* cited by examiner

LOCKABLE LIFT DEVICE AND METHOD

CROSS-REFERENCE TO RELATED APPLICATIONS

Priority is claimed to U.S. Provisional Application No. 61/986,573, filed Apr. 30, 2014, the entire contents of which are incorporated herein by reference.

FIELD OF THE DISCLOSURE

The present disclosure relates generally to a lift having a platform movable between different elevations and, more particularly, to a lift having a platform that is lockable to secure the platform in a raised position.

BACKGROUND

Lifts are used in a variety of different applications to raise and lower objects and people from a first elevation to at least a second elevation. In an industrial setting (e.g., a factory or warehouse), a lift may be used to transport heavy machinery and pallets of goods to and from balconies, mezzanines, basements, and/or between floors. Three types of lifts commonly used in an industrial setting are vertical reciprocating conveyors (VRCs), elevators, and scissor lifts.

A VRC typically includes a platform that supports the cargo and a pair of spaced apart vertical guide columns which guide the platform along a vertical path between the lower and upper levels. Fewer or more vertical guide columns may be utilized by the VRC (e.g., three or four vertical guide columns) depending on the application and type of cargo. Some VRCs employ a single mast from which the platform is cantilevered. To change the height of the platform, most VRCs employ an automated pulley that is mounted on a crossbar spanning the vertical guide columns and connected to the platform via a belt or chain. In general, safety regulations limit VRCs to carrying cargo and not passengers.

An elevator generally includes an enclosed car having a retractable door, a counterweight, a hoistway or shaft through which the car travels, a drive system, and various safety features that prevent free fall such as brakes and a governor. The safety features and design of an elevator make it suitable for human passengers, but the costs of installing and maintaining the elevator as well as other functional limitations may outweigh the benefit of human passengers in some industrial applications.

Scissor lifts employ a plurality of linked, folding supports arranged in a crisscross pattern that form one or more pantograph assemblies to operatively connect the platform to a base. The platform is raised by applying pressure to at least one of the folding supports in a manner that elongates the crisscross pattern and thereby propels the platform vertically. Descent is accomplished by collapsing the crisscross pattern. The crisscross pattern of folding supports is fairly resistant to sway and thus results in a relatively stable platform. As such, regulations typically allow an operator of a scissor lift to ride on the platform together with the cargo.

One common way to power a scissor lift is to provide a hydraulic actuator that exerts pressure on one of the folding supports to move the folding support into an upright position. The other folding supports, by virtue of their linked connection to the actuated folding support, are also turned upright, thereby causing the entire crisscross pattern of folding supports to elongate and push the platform in the upward direction.

A conventional scissor lift may depend solely on the hydraulic actuator to maintain the platform in a raised position. Because of the tendency of hydraulic actuators to slowly lose pressure over time, stationing the platform at an upper level for an extended period of time may result in the platform descending below the upper level. Unintentional descent of the platform may occur, for example, if heavy cargo is left on the platform for prolonged periods (e.g., overnight). Unintentional descent may also occur if a critical component of the scissor lift is accidentally removed during repair or maintenance while the platform is raised.

Another issue with conventional scissor lifts is that the platform may experience some sway during loading and unloading, particularly if the platform is loaded and unloaded at a high level where the crisscross pattern of folding supports is elongated to its maximum extent.

SUMMARY

According to one aspect of the disclosure, a scissor lift includes one or more of the following features and/or arrangements: a base, a platform having a fixed horizontal orientation and being movable between a first elevation and a second elevation, a plurality of pivotally connected scissor links arranged in a crisscross pattern and operatively connecting the base and the platform, a lift actuator pivotally attached to at least one of the scissor links to selectively raise and lower the platform along a lift path, a support column extending alongside the lift path and positioned adjacent to the platform, and a locking actuator fixed to an underside of the platform. The locking actuator includes a piston member that is extendable toward the support column to operatively connect the platform with the support column when the platform is raised so that the platform is supported by the support column in the fixed horizontal orientation.

In some arrangements, a locking receptacle is carried by the support column, and the piston member is received within the locking receptacle when the platform is operatively connected to with the support column.

In some arrangements, the scissor links pivot about a first axis and the piston member moves reciprocally along a second axis. In some arrangements, the second axis is not parallel with the first axis. The first axis may be perpendicular to the second axis. In some arrangements, the first axis may be parallel to the second axis.

In some arrangements, a second support column is positioned adjacent to the platform. The second column may extend to and between the first elevation and the second elevation. A first locking receptacle may be positioned along the first support column and include a first opening. A second locking receptacle may be positioned along the second support column and include a second opening. A second locking actuator may be fixed to the underside of the platform and include a second piston member extendable into the second opening of the second receptacle. The scissor links pivot about a first axis and the first and second locking receptacles define a second axis. The second axis may be in a non-parallel orientation or a parallel orientation in relation to the first axis.

According to another aspect of the disclosure, a lift includes one or more of the following features and/or arrangements: a platform movable between at least a first elevation and a second elevation, a lift mechanism configured to selectively raise the platform from the first elevation to the second elevation, a first locking receptacle positioned at the second elevation, the first locking receptacle including a first opening, and a first locking actuator fixed to an underside of the platform, the first locking actuator comprising a first piston member extendable into the first opening of the first receptacle when the platform is at the second elevation. The first locking receptacle includes an electronic position sensor assembly arranged to sense when the piston member is extended into the locking receptacle and/or separately to sense when the first piston member is seated on the seating surface.

In some arrangements, the electronic position sensor assembly may comprises a single position sensor, wherein the single position sensor, in combination with a controller that controls actuation of the lift mechanism, senses when the first piston member is extended into the locking receptacle and separately senses when the first piston member is seated on the seating surface. The single position sensor may include a sensor arm, the sensor arm being rotatable and biased by a spring to an at-rest position, and a proximity sensor arranged to sense when the sensor arm is disposed at the at-rest position. A first movement of the sensor arm away from the at-rest position to an engaged position may indicate that the first piston member is extended into the locking receptacle. A second movement of the sensor arm back from the engaged position to the at-rest position may indicate that the first piston member is seated on the seating surface.

In some arrangements, the first locking actuator may include a first hydraulic cylinder that moves the piston member. A pressure switch may be arranged to detect when the first piston member is fully extended relative to the first hydraulic cylinder. The electronic sensor assembly and the pressure switch may be arranged to provide redundant confirmation that the first piston member is fully extended.

In some arrangements, a second locking receptacle may be positioned at the second elevation, the second locking receptacle and including a second opening. A second locking actuator may be fixed to the underside of the platform. The second locking actuator may include a second piston member extendable into the second opening of the second receptacle when the platform is at the second elevation. The first locking receptacle may be positioned on a first support structure positioned adjacent the platform at the second elevation. The second locking receptacle may be positioned on a second support structure positioned adjacent the platform at the second elevation. The first support structure may include a first column positioned adjacent the platform and extending between the first elevation and the second elevation. The second support structure may include a second column positioned adjacent the platform and extending between the first elevation and the second elevation.

In some arrangements, the lift mechanism may be in the form of or include a scissor lift. The scissor lift may have a plurality of pivotally connected scissors links arranged in a crisscross pattern and a hydraulic lift actuator operatively connected to the scissor links so as to cause the scissor links to unfold and fold in order to respectively raise and lower the platform.

According to a further aspect of the disclosure, a method of operating a lift includes one or more of the following features and/or steps: a platform and an actuator fixed to an underside of the platform, the actuator including an extendable piston member is provided, raising the platform from a first elevation to a second elevation, extending the piston member through an opening formed in a locking receptacle, sensing with an electronic sensor assembly that the piston member has been extended into the locking receptacle, lowering the platform to a third elevation, located between the first elevation and second elevation, so that the piston member is moved into contact with a seating surface formed by the receptacle, and sensing that the piston member is seated on the seating surface with the electronic sensor assembly.

In some arrangements, the method includes sensing when the piston is fully extended with a pressure switch operatively connected to a hydraulic cylinder arranged to operate the piston member, thereby providing a redundant confirmation that the piston member has been extended into the locking receptacle.

Additional aspects and arrangements of the disclosure will become apparent upon studying the following detailed description of an exemplary arrangement and the accompanying drawings.

DETAILED DESCRIPTION

Figure 1:
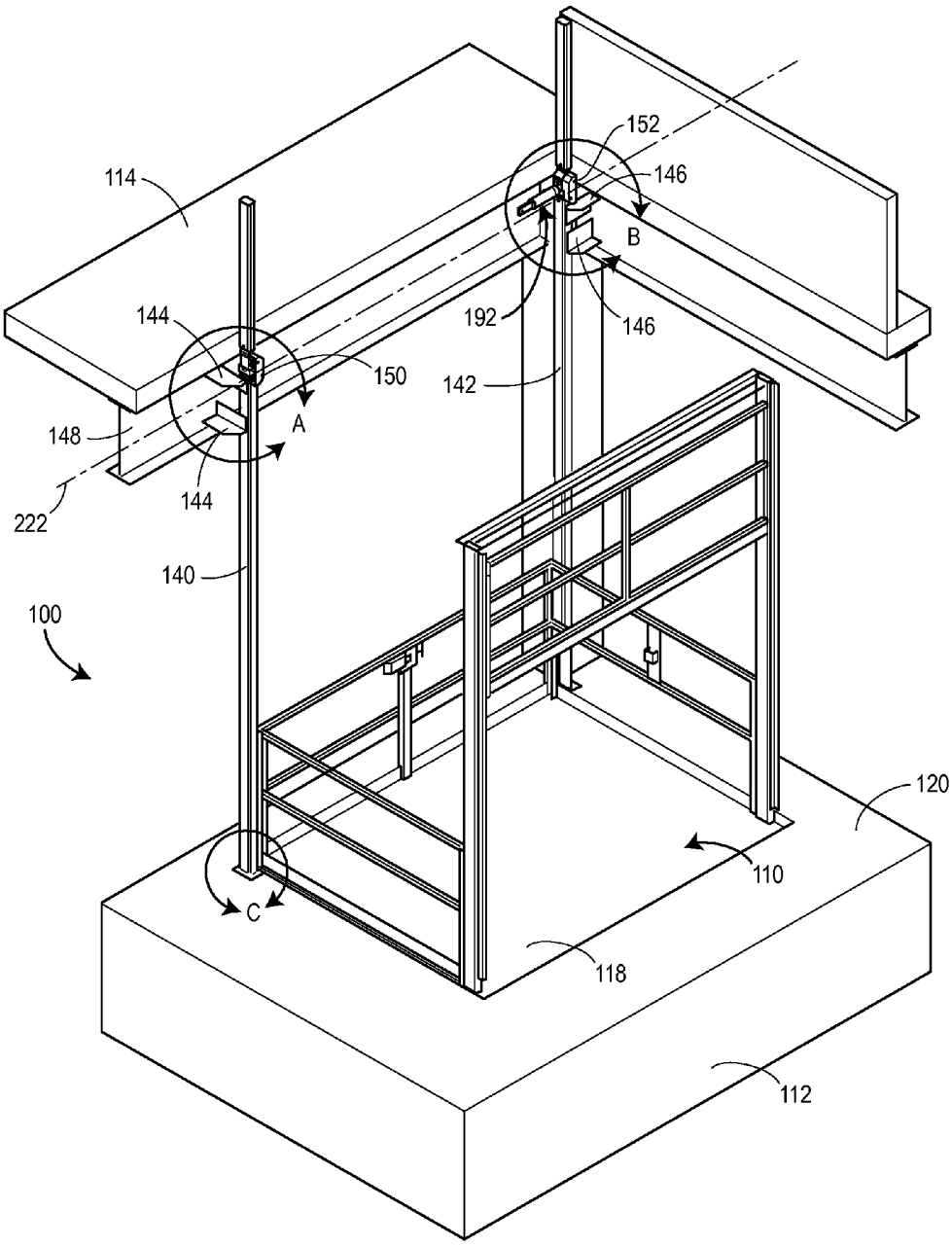
FIG. 1 is a perspective view of one embodiment of a lift in accordance with principles of the present disclosure having a platform in a lowered position.
Figure 2:
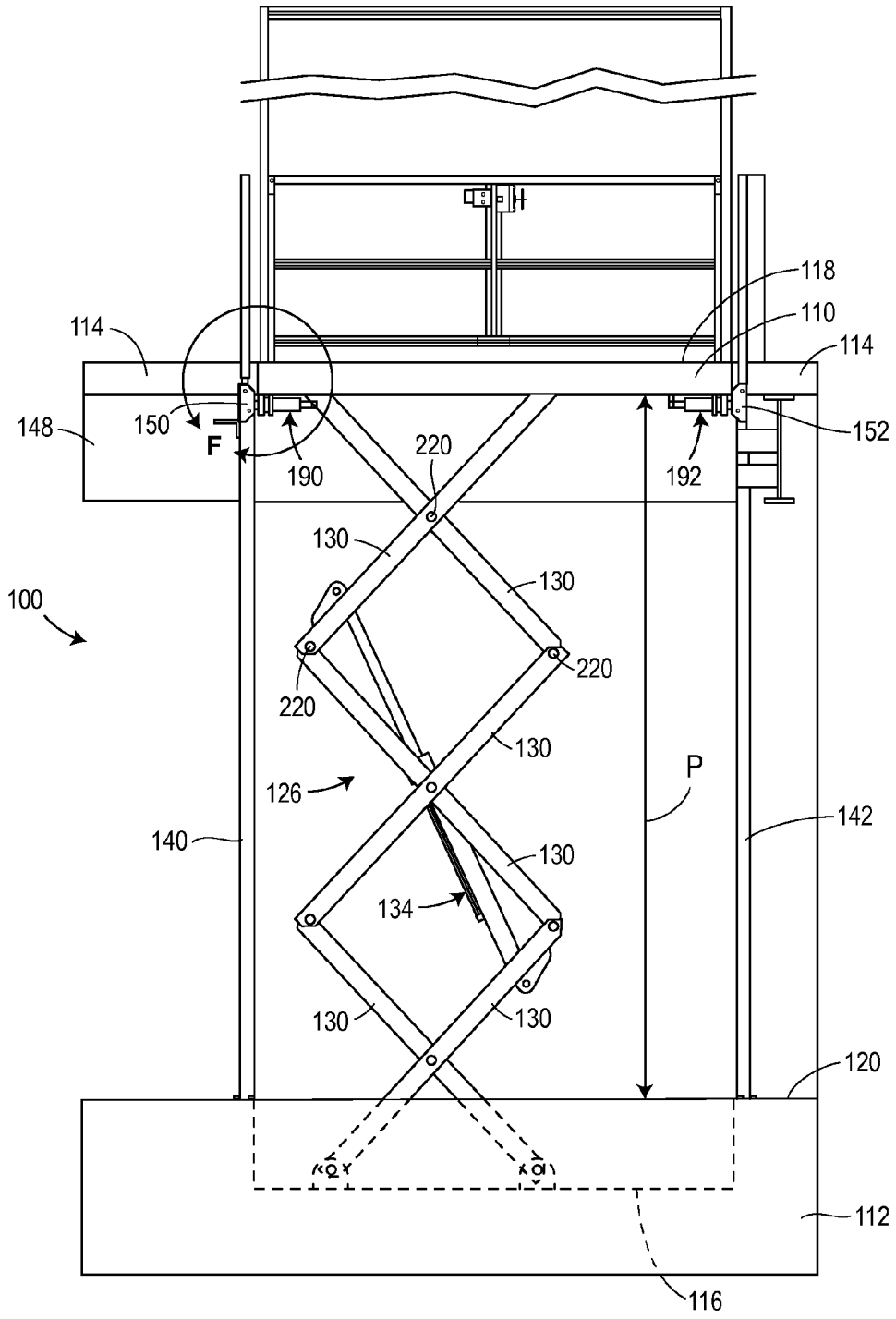
FIG. 2 is a side view of the lift illustrated in FIG. 1 with the platform in a raised position.

FIGS. 1 and 2 illustrate one embodiment of a lift 100 having a platform 110 movable between a ground level 112 and an upper level 114 along a lift path P (shown in FIG. 2). The ground level 112 may be formed with a recess or pit 116 into which the platform 110 is retracted, as illustrated in FIG. 1, so that an upper surface 118 of the platform 110 is flush with a floor surface 120 of the ground level 112. A lift mechanism 126 is used to raise and lower the platform 110 and, in the present embodiment, is formed by a plurality of pivotally connected scissor links 130 arranged in a crisscross pattern that form one or more pantograph assemblies and a hydraulic lift actuator 134. The lift actuator 134 is pivotally connected at opposite ends to two of the scissors links 130. When the platform 110 is lowered to the ground level 112, the scissor links 130 are folded on top of each other in a compact arrangement within the pit 116. Extension of the lift actuator 134 causes the scissor links 130 to unfold thereby elongating the crisscross pattern and propelling the platform 110 in the upward direction. To lower the platform 110, the lift actuator 134 is retracted, for example, by opening a valve that releases hydraulic fluid from a cylinder of the lift actuator 134, which causes the crisscross pattern of scissor links 130 to collapse under the weight of the platform 110 or otherwise. While the lift 100 of the present embodiment is configured as a scissor type lift, alternative embodiments can be arranged differently, for example, with the lift 100 configured as a vertically reciprocating conveyor (VRC) or as an elevator or any other vertically displaceable platform, as may be desired for any suitable purpose.

Still referring to FIGS. 1 and 2, the lift 100 of this version includes two spaced apart hollow support columns 140, 142 positioned adjacent to the platform 110 and which extend vertically alongside the lift path P. As shown in FIG. 1, brackets 144, 146 may fix each of the support columns 140, 142 to a support structure 148 (e.g., an I-beam) at the upper level 114 to provide the support columns 140, 142 with lateral stability. Fewer or more support columns than the two support columns illustrated in FIGS. 1 and 2 can be utilized by the lift 100. In one embodiment, four support columns can be utilized, with each support column being positioned adjacent to a respective corner of the platform 110.

Locking receptacles 150, 152 are positioned on each of the support columns 140, 142 at the upper level 114. As more clearly shown in FIGS. 10-14, each locking receptacle 150, 152 can include a lower mounting portion 156, a centrally located locking portion 160, and an upper accessory mounting portion 164. FIGS. 1-14 only show locking receptacle 152 for exemplary purposes, it being understood that locking receptacle 150 is preferably identical thereto. The mounting portions 156 are adapted to be inserted into top portions of the hollow support columns 140, 142, and subsequently fixed into position (e.g., by welding). The mounting portions 156 in one version can be approximately 3 inches in length to allow for some play such that the final vertical position of the receptacles 150, 152 relative to the corresponding support columns 140, 142 can be adjusted before welding. This allows for proper positioning of the receptacles 150, 152 relative to the upper level 114. An opening 174 is formed in an external wall 176 of the locking portion 160 that opens into a hollow interior of the locking receptacles 150, 152. The opening 174 is defined (e.g., bounded) on one side by a seating surface 180, which may be semi-cylindrical and/or have a tapered (e.g., frustoconical) entry surface to facilitate insertion of an object into the locking portion 160.

Figure 5:
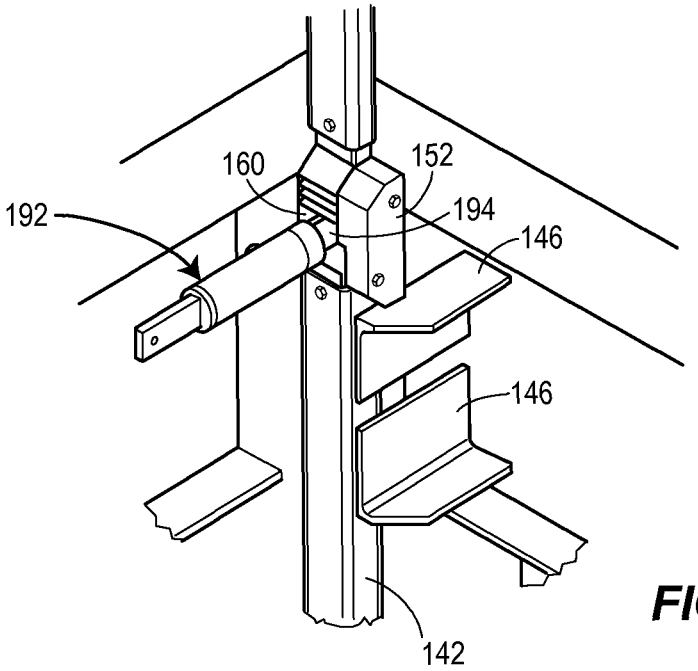
FIG. 5 illustrates an enlarged view of the portion of FIG. 1 enclosed by circle B.
Figure 6:
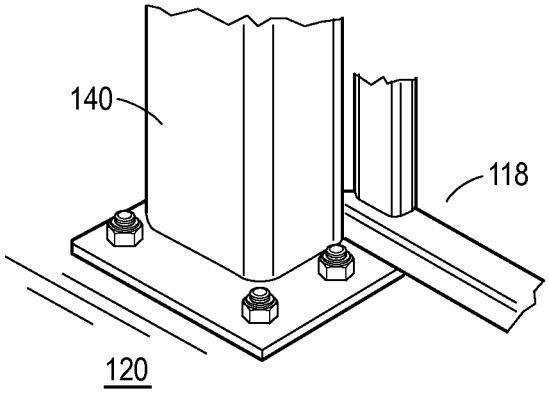
FIG. 6 is an enlarged view of the portion of FIG. 1 enclosed by circle C.
Figure 7:
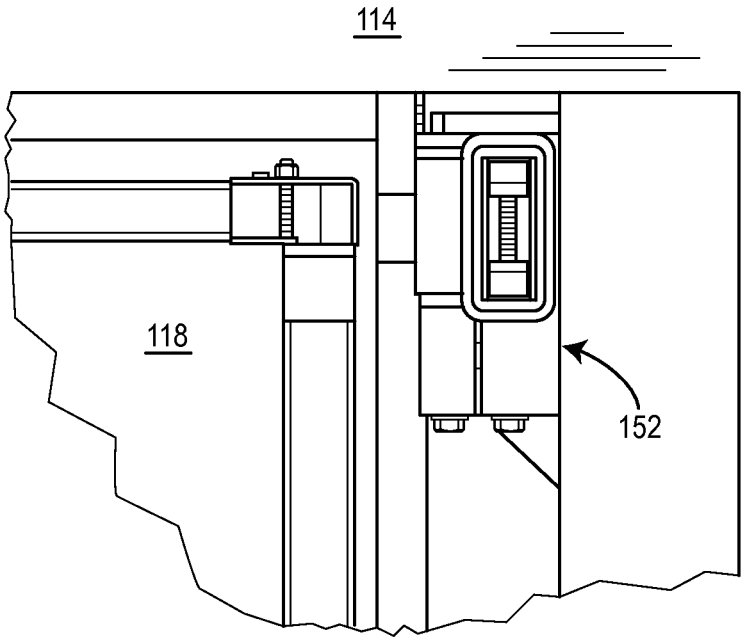
FIG. 7 is an enlarged view of the portion of FIG. 3 enclosed by circle D.
Figure 8:
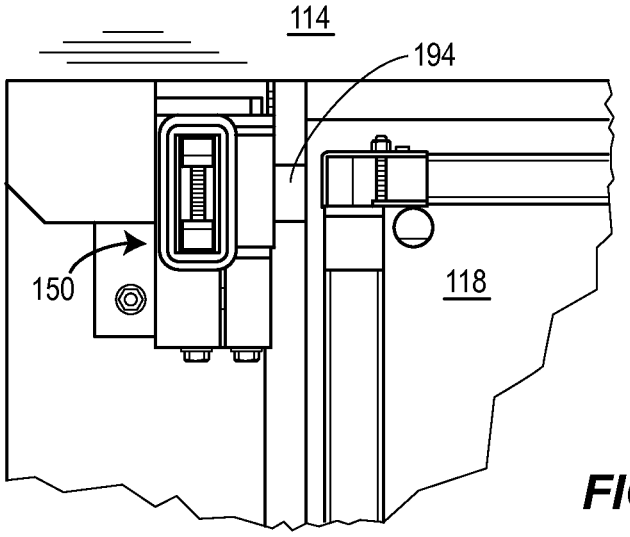
FIG. 8 is an enlarged view of the portion of FIG. 3 enclosed by circle E.
Figure 9:
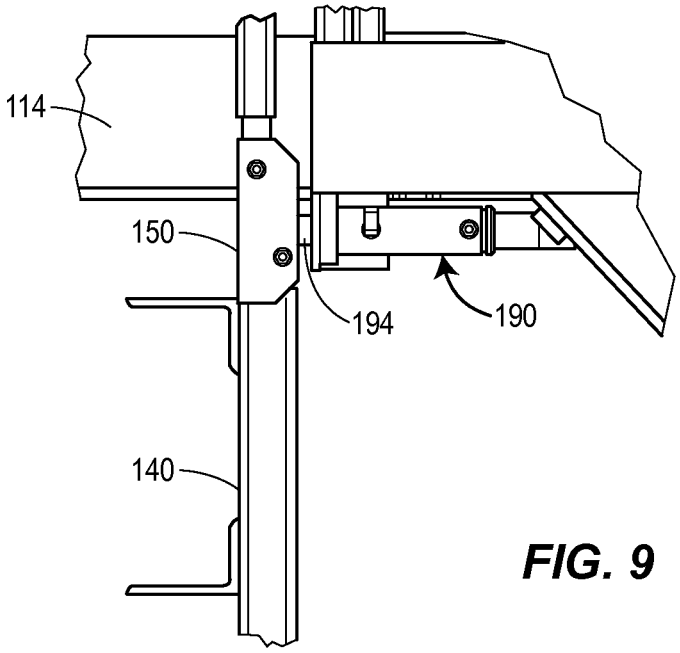
FIG. 9 is an enlarged view of the portion of FIG. 2 enclosed by circle F.
Figure 10:
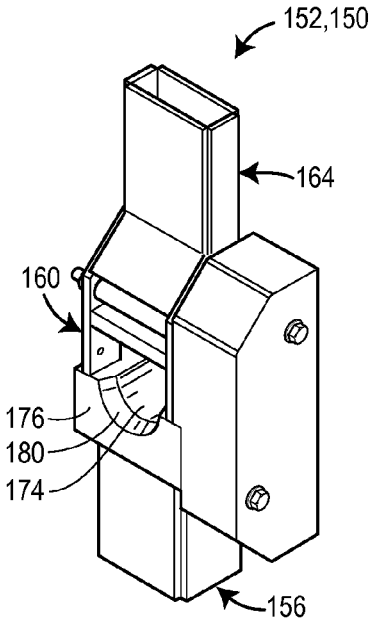
FIG. 10 is a perspective view of the front of a locking receptacle.
Figure 11:
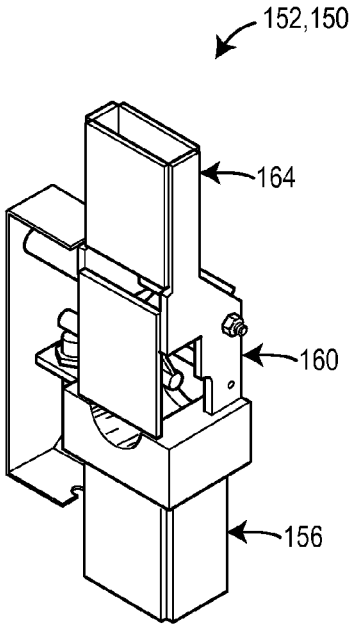
FIG. 11 is a perspective view of the rear of the locking receptacle shown in FIG. 10.
Figure 12:
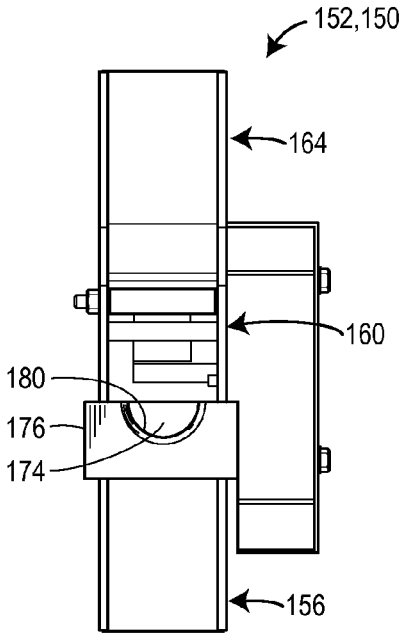
FIG. 12 is a front plan view of the locking receptacle illustrated in FIG. 10.
Figure 13:
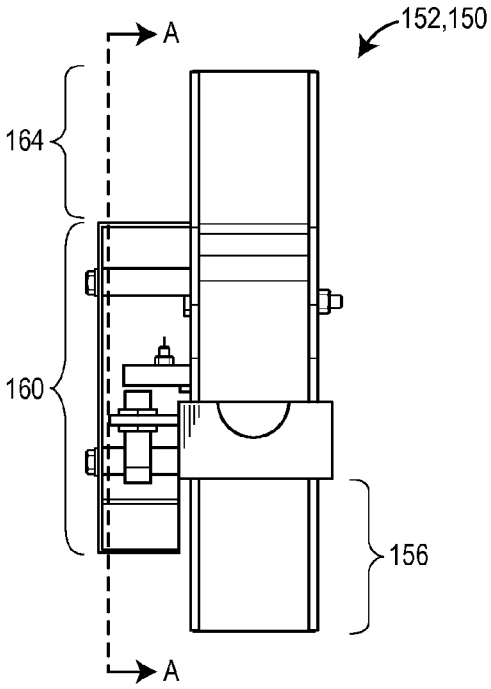
FIG. 13 is a rear plan view of the locking receptacle depicted in FIG. 10.
Figure 15:
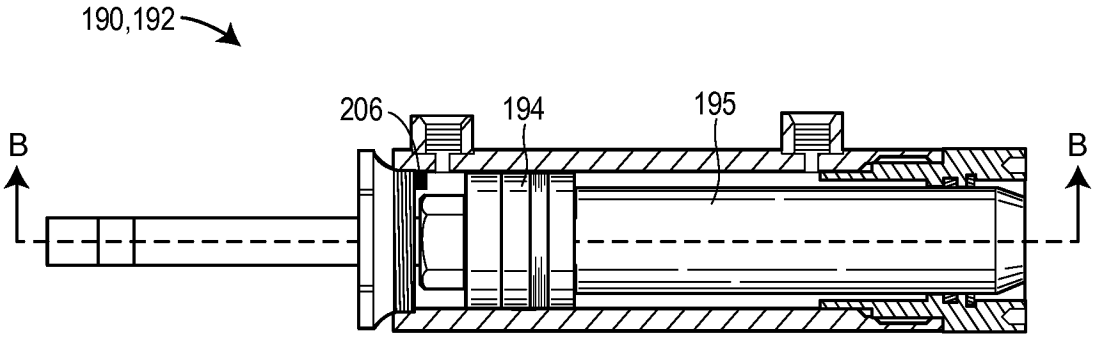
FIG. 15 is a side view of a hydraulic locking actuator.
Figure 16:
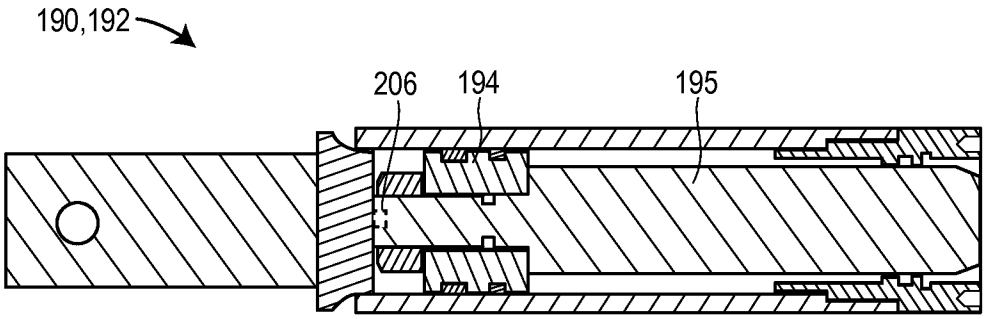
FIG. 16 is a cross-sectional view of the hydraulic locking actuator of FIG. 15 taken along line B-B.

Referring again to FIG. 2, two hydraulic locking actuators 190, 192 are fixed to an underside of the platform 110. As shown in FIGS. 15 and 16, for example, each locking actuator 190, 192 includes a piston member 194 that is movable along a direction substantially perpendicular to the lift path P. In the disclosed version, the piston member 194 includes a rod portion 195 extending from a distal end thereof that has a tapered (e.g., frustoconical) end to facilitate insertion into the respective receptacle 150 or 152, as will be described. In one embodiment, the locking actuators 190, 192 are supplied with hydraulic fluid from the same source that supplies the lift actuator 134. When the platform 110 is positioned at the upper level 114, the piston member 194 of the hydraulic actuator 170 is substantially aligned with the opening 174 formed in the exterior wall 176 of the locking receptacle 150 so that the piston member 194 can be extended into the hollow interior of the locking receptacle 150, as shown in FIG. 9. Similarly, the piston member 194 of the hydraulic actuator 192 is substantially aligned with the opening 174 in the exterior wall 176 of the locking receptacle 152 so that the piston member 194 can be extended into the hollow interior of the locking receptacle 152, as seen in FIG. 5. As discussed below in more detail, after the piston members 194, 196 have been inserted into their respective locking receptacles 150, 152, the platform 110 may be lowered by a small distance, e.g., approximately 0.25 to approximately 1.5 inches, to ensure that the piston members 194 rest securely on their respective seating surfaces 180. The engagement of the piston members 194 and the locking receptacles 150, 152 secures the platform 110 to the support columns 140, 142 and thereby prevents the platform 110 from unintentionally sinking below the upper level 114 due to, for example, hydraulic pressure leakage from the lift actuator 134.

In this embodiment, because the receptacles 150, 152 are fixed to the support columns 140, 142, respectively, and the tops of the support columns 140, 142 are fixed to the support structure 148 at the upper level 114, the interlocking of the piston members 194 with the respective receptacles 150, 152 also prevents the platform 110 from displacing horizontally away from the support structure 148. For example, in one embodiment, the locking actuators 190, 192 are positioned so that the cargo passes between the locking actuators 190, 192 when the cargo is loaded/unloaded from the platform 110 at the upper level 114. This configuration of the locking actuators 190, 192 inhibits the platform 110 from swaying due to lateral forces exerted by movement of the cargo on and off of the lift platform 110 because lateral movement of the piston members 194 is prevented by the receptacles 150, 152, which effectively retain the piston members 194 in position.

Figure 14:
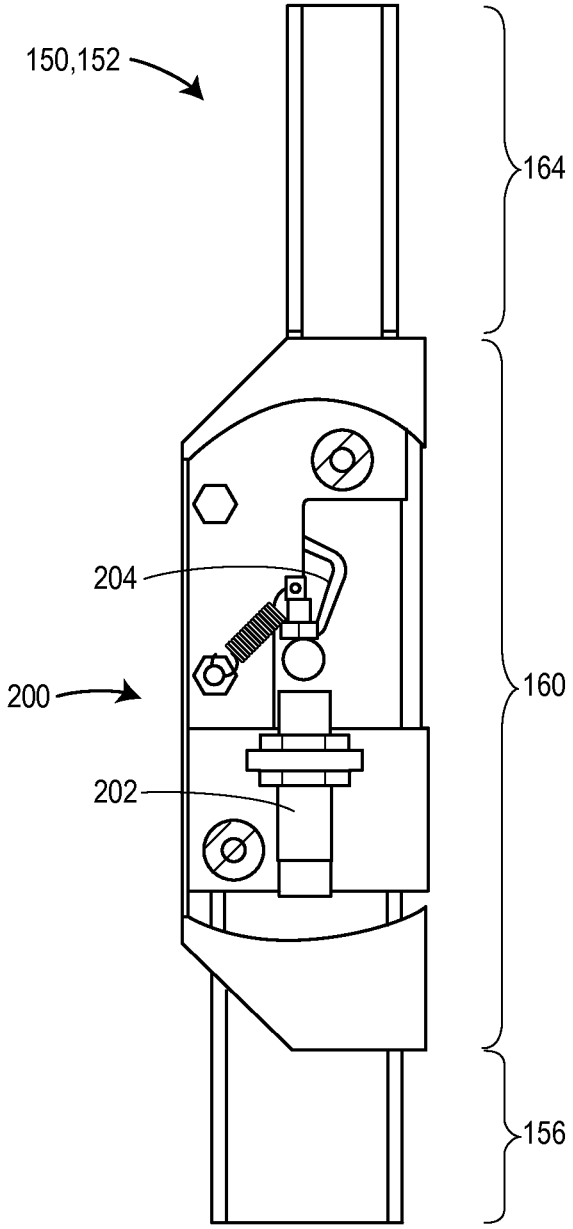
FIG. 14 is a cross-sectional view of the locking receptacle of FIG. 13 taken along line A-A.

Generally, during a raising operation of the lift 100, an operator depresses and optionally holds an "UP" button on a control panel (not illustrated) associated with the lift 100. This causes a controller to energize a hydraulic pump that supplies the lift actuator 134 with pressurized hydraulic fluid. The lift actuator 134 exerts pressure on the lift mechanism 126 thereby causing the lift mechanism 126 to elongate and push the platform 110 in the upward direction along the lift path P. The platform 110 keeps moving upward until it triggers an upper travel limit sensor. The upper travel limit sensor is positioned so that the platform 114 overshoots the upper level 114 by a small distance (e.g., in a range of approximately 0.25 inches to approximately 1.5 inches), but so that the piston members 194 of the actuators 190, 192 are substantially aligned with the locking receptacles 150, 152. The controller then causes the two locking actuators 190, 192 to extend their respective piston members 194 through the respective openings 174 in the locking receptacles 150, 152. When fully extended, the piston members 194 trigger an electronic position sensor assembly arranged to sense when the piston members 194 are fully or properly extended into the locking receptacles and/or to sense when the piston members 194 are properly seated on the seating surfaces 180. As shown in FIG. 14, in one exemplary arrangement, the electronic position sensor assembly includes electronic position sensors 200 located inside the locking receptacles 150, 152. Each position sensor 200 may include a proximity sensor 202 and a spring-biased rotatable sensor arm 204. In the position shown in FIG. 14, the sensor arm 204 is in an at-rest position adjacent the proximity sensor 202, such that the proximity sensor 202 senses the sensor arm 204. The arms 204 are pivoted out of the at-rest positions and thereby away from the proximity sensors 202 when axial ends of the piston members 194 are inserted into the locking receptacles 150, 152 and contact the sensor arms 204. When the sensor arms 204 have pivoted a predetermined amount to an engaged position, the proximity sensors 202 can no longer detect the presence of the sensor arms 204, and the controller confirms that the piston members 194 are fully extended into the receptacles 150, 152. In addition to relying on the position sensors 200 to confirm the extended position of the piston members 194, the system can also be equipped with pressure switches 206, as shown in FIGS. 15 and 16, mounted either in the cylinders that contain the piston members 194, or on hydraulic feed lines to those cylinders. Such pressure switches 206 can detect when the piston members 194 are fully extended and fully retracted relative to the cylinders, thereby giving the controller another, i.e., redundant, level of confirmation that not only do the position sensors 200 in the receptacles 150, 152 indicate that the piston members 194 should be fully extended, but the pressure switches 206 can confirm that in fact the piston members 194 are fully extended. This two-sensor confirmation arrangement can advantageously eliminate any concern of debris possibly being present between the ends of the piston members 194 and the respective pivoting sensor arms 204 of the position sensors 200 in the receptacles 150, 152, which could provide a false reading.

With the piston members 194 fully extended, the controller then operates the lift actuator 134 to lower the platform 110 until the piston members 194 become seated on the seating surfaces 180. As the piston members 194 are lowered onto the seating surfaces 180, the axial ends of the piston members 194 slide out of contact with the pivoting sensor arms 204 of the position sensors 200, which in turn allows the springs to automatically bias the sensor arms 204 back into the at-rest position illustrated in FIG. 14. In this position, the proximity sensors 202 can again detect the presence of the sensor arms 204, thereby providing an indication that the piston members 194 are fully seated on the seating surfaces 180. The platform 110 may be lowered by approximately 0.25 inches to approximately 1.5 inches or some other distance during this phase of the operation. Thus, in this exemplary arrangement, the position sensors 200 help ensure (1) that the piston members 194 have been properly extended into the locking receptacles 150, 152 and (2) that the piston members 194 have been properly seated on the seating surfaces 180.

During a lowering operation, the operator depresses and optionally holds a "DOWN" button on the control panel. Initially, the platform 110 moves in the upward direction until each of the piston members 194 triggers the position sensor 200 located within the respective locking receptacles 150, 152. That is, as mentioned, the pivoting sensor arms 204 of the position sensors 200 will have returned to their home positions depicted in FIG. 14 upon the piston members 194 becoming seated on the seating surfaces 180. Therefore, as the platform 110 and piston members 194, 196 are raised again, the axial ends of the piston members 194 re-engage the sensor arms 204 and force the sensor arms 204 to pivot away from the proximity sensors 202. This causes the proximity sensors 202 to no longer be able to sense the presence of the sensor arms 204, which indicates to the controller that the piston members 194 are sufficiently raised out of contact with the seating surfaces 180. At this point, the controller stops upward movement of the platform 110, retracts the piston members 194 back into their respective cylinders, and then operates the lift actuator 134 to lower the platform 110. The platform 110 continues to move downward until a lower limit sensor at the ground level 112 is triggered.

In another exemplary arrangement, the functionality of the single position sensor 200 in the electronic position sensor assembly may be divided into multiple electronic sensors in communication with the controller. For example, in another arrangement, the electronic position sensor assembly a first position sensor that may be provided to detect when the piston member 194 is properly extended into the locking receptacle 150 or 152, and a second position sensor that may be provided to detect when the piston member 194 is properly seated on the seating surface 180. The controller receives signals from the position sensor 200 or position sensors and controls movement of the lift as described herein based on the received signals.

In the present embodiment, the support columns 140, 142 are not utilized as guide rails to keep the platform 110 from deviating from the lift path P. The platform 110 is free from contact with the support columns 140, 142 as the platform 110 travels along the lift path P. It is only when the platform 110 is locked into position at the upper level 114 that the platform 114 becomes operatively engaged to the support columns 140, 142 and support structure 148. Other embodiments of the lift 100 can be arranged differently, for example, with the support columns 140, 142 having tracks that receive rollers attached to the sides of the platform 110 to guide the platform along the lift path P.

Additionally, while the foregoing disclosure focuses on fixing the platform 110 only at a single elevated height (i.e., the upper level 114 of the support structure 148), the system could also be configured to lock the platform at multiple heights to multiple different support structures such as floors, mezzanines, or otherwise.

Further yet, while the locking system has been disclosed as including piston members 194 that cooperate with receptacles 150, 152, other types of locking systems could be used to accomplish similar objectives without necessarily departing from the scope of the disclosure.

Further still, while the disclosed configuration includes the receptacles 150, 152 fixed to vertical support columns 140, 142 that extend from the floor surface 120 up to the upper level 114, where they are fixed to the support structure 148, alternative configurations could foreseeably include the receptacles 150, 152 being fixed directly to the support structure 148 at the upper level 114. In this type of configuration, it is possible that no vertical support columns 140 or 142 would be needed.

Figure 3:
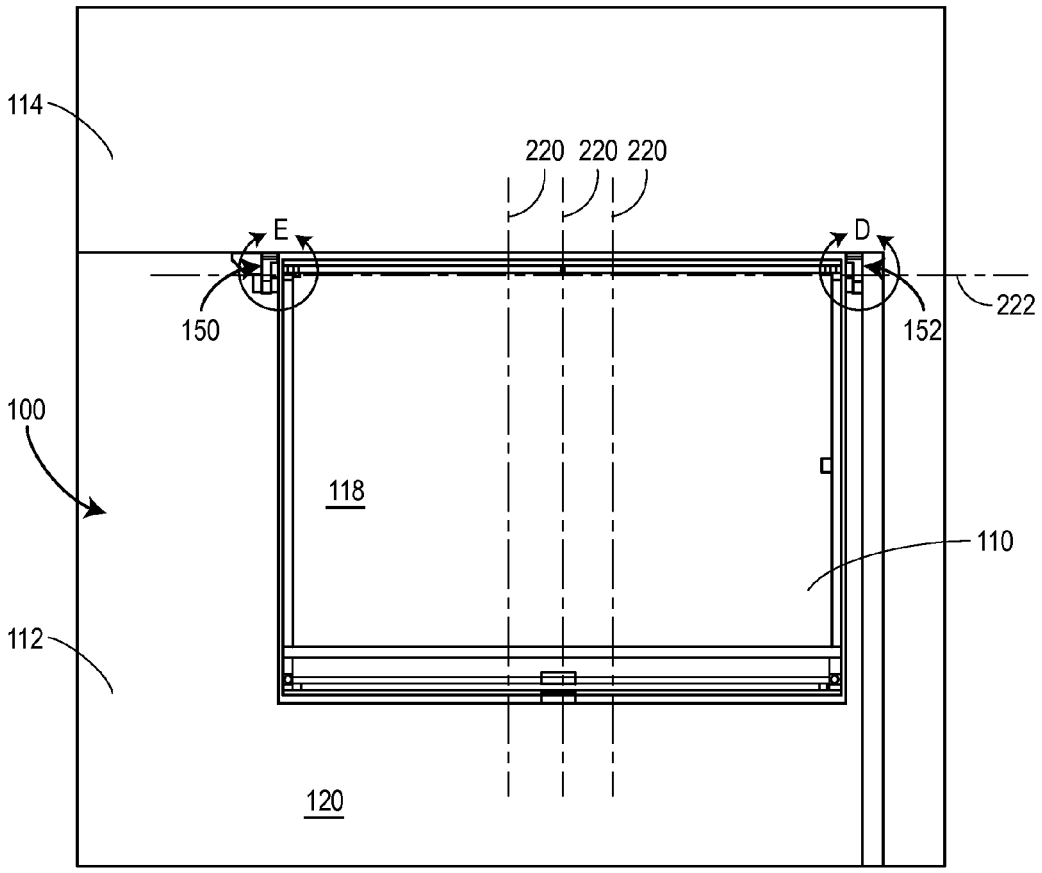
FIG. 3 is a top view of the lift illustrated in FIG. 1 in the raised position of FIG. 2.
Figure 4:
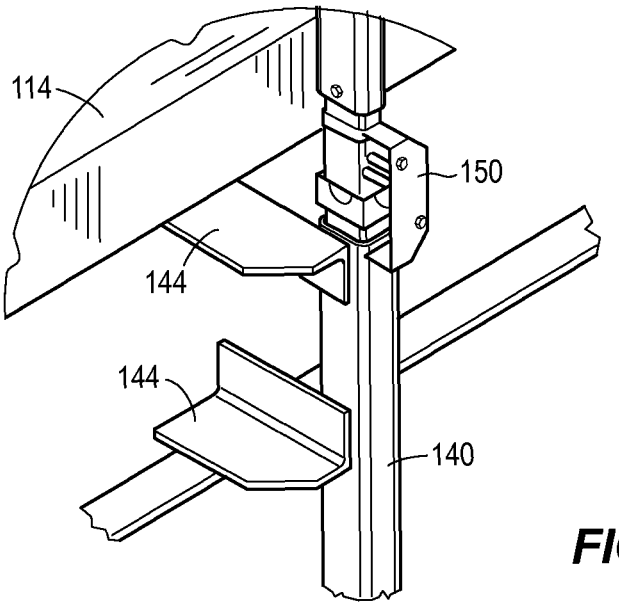
FIG. 4 depicts an enlarged view of the portion of FIG. 1 enclosed by circle A.

The platform 110 is preferably held in a horizontally fixed orientation, i.e., not capable of pivoting or tilting or being pivoted or tilted from its fixed orientation at all times, at least when the piston members 194 are securely resting on their respective seating surfaces 180. More preferably, the platform 110 is held in its horizontally fixed orientation at all positions between the lowered position and the raised position. The lift mechanism 126 is connected to the platform 110 in such a manner that the platform 110 is not able to pivot or tilt when the platform 110 is locked into position at the upper level by means of interaction between the piston members 194 and the locking receptacles 150, 152, as described above. For example, in the exemplary arrangement of the figures, the scissor links 130 are pivotably connected to pivot about one or more axes 220. The axes 220 are all oriented parallel to each other in a single direction. In comparison, the locking receptacles 150, 152 are oriented along a second axis 222, which is not parallel to the axes 220. Preferably, the axes 220 are all oriented horizontally and aligned in a front-to-back orientation, as depicted in FIG. 3. Also preferably, the axis 222 is oriented horizontally and aligned in a side-to-side orientation. For example, the axis 222 is preferably perpendicularly oriented in a horizontal plane relative to the axes 220. However, in other arrangements, the second axis 222 may be oriented parallel to the axes 220. In the exemplary arrangement of the figures, the piston members 194 of the hydraulic actuators 190, 192 are axially aligned along the axis 222, although the piston members 194 do not necessarily need to be so aligned. Thus, when the piston members 194 are locked into the respective locking receptacles 150, 152, the interaction between the lift mechanism 126, the platform 110, and the locking receptacles 150, 152 helps ensure that the platform 110 is maintained fixed in its horizontal orientation without being able to pivot or tilt in case the lift mechanism 126 were to shift slightly downwardly over time, for example, due to a loss of hydraulic pressure. This arrangement may improve the stability of the lift 100 and/or help maintained the platform 110 in a preferred preselected fixed horizontal orientation.

While the present disclosure has been described with respect to certain embodiments, it will be understood that variations may be made thereto that are still within the scope of the appended claims.

What is claimed is:

1. A scissor lift comprising:

a base;

a platform having a fixed horizontal orientation and being movable between a first elevation and a second elevation;

a plurality of pivotally connected scissor links arranged in a crisscross pattern and operatively connecting the base and the platform;

a lift actuator pivotally attached to at least one of the scissor links to selectively raise and lower the platform along a lift path;

a support column extending alongside the lift path and positioned adjacent to the platform;

a locking actuator fixed to an underside of the platform, the locking actuator comprising a piston member extendable toward the support column to operatively connect the platform with the support column when the platform is raised at the second elevation so that the platform is supported by the support column in the fixed horizontal orientation; and a locking receptacle carried by the support column, wherein the piston member is received within the locking receptacle when the platform is operatively connected to the support column, wherein each of the plurality of the scissor links pivots about a first axis of a plurality of respective first axes and the piston member moves reciprocally along a second axis, wherein the second axis is not parallel with any of the first axes.

2. The scissor lift of claim 1, wherein each first axis is perpendicular to the second axis.

3. The scissor lift of claim 1, further comprising:

a second support column positioned adjacent to the platform and extending at least between the first elevation and the second elevation;

a first locking receptacle positioned along the first support column and including a first opening;

a second locking receptacle positioned along the second support column and including a second opening; and a second locking actuator fixed to the underside of the platform and including a second piston member extendable into the second opening of the second locking receptacle, wherein the first and second locking receptacles define a third axis, the third axis being non-parallel to each of the first axes.

4. A lift comprising:

a platform movable between at least a first elevation and a second elevation;

a lift mechanism configured to selectively raise the platform from the first elevation to the second elevation;

a first locking receptacle positioned at the second elevation, the first locking receptacle including a first opening and a first seating surface;

a first locking actuator fixed to an underside of the platform, the first locking actuator comprising a first piston member extendable into the first opening of the first locking receptacle when the platform is at the second elevation;

wherein the first locking receptacle further comprises:

an electronic position sensor assembly arranged to sense when the piston member is extended into the locking receptacle and separately to sense when the first piston member is seated on the first seating surface, wherein the electronic position sensor assembly comprises a single position sensor, wherein the single position sensor, in combination with a controller that controls actuation of the lift mechanism, senses when the first piston member is extended into the locking receptacle and separately senses when the first piston member is seated on the first seating surface, wherein the single position sensor comprises:

a sensor arm, the sensor arm being rotatable and biased by a spring to an at-rest position; and a proximity sensor arranged to sense when the sensor arm is disposed at the at-rest position, wherein a first movement of the sensor arm away from the at-rest position to an engaged position indicates that the first piston member is extended into the first locking receptacle, and wherein a second movement of the sensor arm back from the engaged position to the at-rest position indicates that the first piston member is seated on the first seating surface.

5. The lift of claim 4, further comprising:

wherein the first locking actuator comprises a first hydraulic cylinder that moves the piston member; and a pressure switch arranged to detect when the first piston member is fully extended relative to the first hydraulic cylinder, wherein the electronic sensor assembly and the pressure switch provide redundant confirmation that the first piston member is fully extended.

6. The lift of claim 4, further comprising:

a second locking receptacle positioned at the second elevation, the second locking receptacle including a second opening; and a second locking actuator fixed to the underside of the platform, the second locking actuator comprising a second piston member extendable into the second opening of the second receptacle when the platform is at the second elevation, wherein the first locking receptacle is positioned on a first support structure positioned adjacent the platform at the second elevation, and wherein the second locking receptacle is positioned on a second support structure positioned adjacent the platform at the second elevation.

7. The lift of claim 6, wherein the first support structure comprises a first column positioned adjacent the platform and extending between the first elevation and the second elevation, and wherein the second support structure comprises a second column positioned adjacent the platform and extending between the first elevation and the second elevation.

8. The lift of claim 4, wherein the lift mechanism is a scissor lift comprising a plurality of pivotally connected scissors links arranged in a crisscross pattern and a hydraulic lift actuator operatively connected to the scissor links so as to cause the scissor links to unfold and fold in order to respectively raise and lower the platform.

9. A method of operating a lift including a platform and an actuator fixed to an underside of the platform, the actuator including an extendable piston member, the method comprising:

raising the platform from a first elevation to a second elevation;

extending the piston member through an opening formed in a locking receptacle;

sensing with an electronic sensor assembly that the piston member has been extended into the locking receptacle;

lowering the platform to a third elevation located between the first elevation and the second elevation, so that the piston member is moved into contact with a seating surface formed by the receptacle; and sensing that the piston member is seated on the seating surface with the electronic sensor assembly.

10. The method of claim 9, further comprising:

sensing when the piston is fully extended with a pressure switch operatively connected to a hydraulic cylinder arranged to operate the piston member, thereby providing a redundant confirmation that the piston member has been extended into the locking receptacle.

11. A lift comprising:

a platform movable between at least a first elevation and a second elevation;

a lift mechanism configured to selectively raise the platform from the first elevation to the second elevation;

a first locking receptacle positioned at the second elevation, the first locking receptacle including a first opening and a first seating surface;

a first locking actuator fixed to an underside of the platform, the first locking actuator comprising a first piston member extendable into the first opening of the first locking receptacle when the platform is at the second elevation;

wherein the first locking receptacle further comprises:

an electronic position sensor assembly arranged to sense at least one of the following: (a) when the piston member is extended into the first locking receptacle, or (b) when the first piston member is seated on the first seating surface, wherein the first locking actuator comprises a first hydraulic cylinder that moves the piston member; and a pressure switch arranged to detect when the first piston member is fully extended relative to the first hydraulic cylinder, wherein the electronic sensor assembly and the pressure switch provide redundant confirmation that the first piston member is fully extended.

12. The lift of claim 11, wherein the electronic position sensor assembly comprises a single position sensor, wherein the single position sensor, in combination with a controller that controls actuation of the lift mechanism, senses (a) when the first piston member is extended into the locking receptacle and (b) when the first piston member is seated on the first seating surface.

13. The lift of claim 12, wherein the single position sensor comprises:

a sensor arm, the sensor arm being rotatable and biased by a spring to an at-rest position; and a proximity sensor arranged to sense when the sensor arm is disposed at the at-rest position, wherein a first movement of the sensor arm away from the at-rest position to an engaged position indicates that the first piston member is extended into the first locking receptacle, and wherein a second movement of the sensor arm back from the engaged position to the at-rest position indicates that the first piston member is seated on the first seating surface.

14. The lift of claim 11, further comprising:

a second locking receptacle positioned at the second elevation, the second locking receptacle including a second opening; and a second locking actuator fixed to the underside of the platform, the second locking actuator comprising a second piston member extendable into the second opening of the second receptacle when the platform is at the second elevation, wherein the first locking receptacle is positioned on a first support structure positioned adjacent the platform at the second elevation, and wherein the second locking receptacle is positioned on a second support structure positioned adjacent the platform at the second elevation.

15. The lift of claim 14, wherein the first support structure comprises a first column positioned adjacent the platform and extending between the first elevation and the second elevation, and wherein the second support structure comprises a second column positioned adjacent the platform and extending between the first elevation and the second elevation.

16. The lift of claim 11, wherein the lift mechanism is a scissor lift comprising a plurality of pivotally connected scissors links arranged in a crisscross pattern and a hydraulic lift actuator operatively connected to the scissor links so as to cause the scissor links to unfold and fold in order to respectively raise and lower the platform.

17. A lift comprising:

a platform movable between at least a first elevation and a second elevation;

a lift mechanism configured to selectively raise the platform from the first elevation to the second elevation;

a first locking receptacle positioned at the second elevation, the first locking receptacle including a first opening and a first seating surface;

a first locking actuator fixed to an underside of the platform, the first locking actuator comprising a first piston member extendable into the first opening of the first locking receptacle when the platform is at the second elevation;

wherein the first locking receptacle further comprises:

an electronic position sensor assembly arranged to sense at least one of the following: (a) when the piston member is extended into the locking receptacle, or (b) when the first piston member is seated on the first seating surface;

a second locking receptacle positioned at the second elevation, the second locking receptacle including a second opening; and a second locking actuator fixed to the underside of the platform, the second locking actuator comprising a second piston member extendable into the second opening of the second receptacle when the platform is at the second elevation, wherein the first locking receptacle is positioned on a first support structure positioned adjacent the platform at the second elevation, and wherein the second locking receptacle is positioned on a second support structure positioned adjacent the platform at the second elevation, wherein the first support structure comprises a first column positioned adjacent the platform and extending between the first elevation and the second elevation, and wherein the second support structure comprises a second column positioned adjacent the platform and extending between the first elevation and the second elevation.

18. The lift of claim 17, wherein the electronic position sensor assembly comprises a single position sensor, wherein the single position sensor, in combination with a controller that controls actuation of the lift mechanism, senses (a) when the first piston member is extended into the first locking receptacle and (b) when the first piston member is seated on the first seating surface.

19. The lift of claim 18, wherein the single position sensor comprises:

a sensor arm, the sensor arm being rotatable and biased by a spring to an at-rest position; and a proximity sensor arranged to sense when the sensor arm is disposed at the at-rest position, wherein a first movement of the sensor arm away from the at-rest position to an engaged position indicates that the first piston member is extended into the first locking receptacle, and wherein a second movement of the sensor arm back from the engaged position to the at-rest position indicates that the first piston member is seated on the first seating surface.

20. The lift of claim 17, further comprising:

wherein the first locking actuator comprises a first hydraulic cylinder that moves the piston member; and a pressure switch arranged to detect when the first piston member is fully extended relative to the first hydraulic cylinder, wherein the electronic sensor assembly and the pressure switch provide redundant confirmation that the first piston member is fully extended.

21. The lift of claim 17, wherein the lift mechanism is a scissor lift comprising a plurality of pivotally connected scissors links arranged in a crisscross pattern and a hydraulic lift actuator operatively connected to the scissor links so as to cause the scissor links to unfold and fold in order to respectively raise and lower the platform.

* * * * *